US006769141B2

(12) United States Patent
Epple et al.

(10) Patent No.: US 6,769,141 B2
(45) Date of Patent: Aug. 3, 2004

(54) AUTOMATIC POOL COVER BOX EQUIPMENT MOUNTING ASSEMBLY

(75) Inventors: Thomas A. Epple, Fort Wayne, IN (US); Lanny R. Smith, Alpine, UT (US)

(73) Assignee: Fort Wayne Pools, Inc., Ft. Wayne, IN (US)

( * ) Notice: Subject to any disclaimer, the term of this patent is extended or adjusted under 35 U.S.C. 154(b) by 0 days.

(21) Appl. No.: 10/005,839

(22) Filed: Nov. 8, 2001

(65) Prior Publication Data

US 2003/0084501 A1 May 8, 2003

(Under 37 CFR 1.47)

(51) Int. Cl.[7] ..... E04H 4/00

(52) U.S. Cl. ..... 4/502

(58) Field of Search ..... 4/502

(56) References Cited

U.S. PATENT DOCUMENTS 5,105,481 A * 4/1992 Lamb et al. ..... 4/502
5,913,613 A * 6/1999 Ragsdale et al. ..... 4/502

* cited by examiner

*Primary Examiner*—Charles E. Phillips
(74) *Attorney, Agent, or Firm*—Jones, Walker, Waechter, Poitevent, Carrere & Denegre, L.L.P.

(57) ABSTRACT

An equipment mounting assembly for mounting equipment in a pool cover box is provided, including at least one positioning feature configured to engage at least two walls of the pool cover box and at least one mounting plate, the at least one positioning feature adjustably connected to the mounting plate.

8 Claims, 7 Drawing Sheets

AUTOMATIC POOL COVER BOX EQUIPMENT MOUNTING ASSEMBLY

BACKGROUND OF THE INVENTION

1. Field of the Invention

The present invention relates to swimming pools, and, more particularly, to an automatic pool cover box equipment mounting assembly.

2. Description of the Related Art

Swimming pools are commonly covered to prevent debris from entering the pool, to preserve chemical treatments in the water and to heat the pool in the case of a solar cover. An automatic pool cover provides convenience for a user by allowing the cover to be easily extended over the pool during periods of non-use, and retracted during periods of use. Typically, a pool cover box is placed in the decking surrounding the swimming pool at a location opposite from the walk-in steps (usually at the deep end of a pool). The box extends across the width of the swimming pool, and houses an electric motor and reel on which the cover is wound. Within the pool cover box is mounted a reel to store the pool cover on, an electric motor and a mechanism to deploy and retract the pool cover.

A problem with conventional automatic pool cover boxes is that the equipment placed therein requires measurement and customized placement of the parts to accommodate the box. The walls of the pool cover box are cut, positioned and oriented next to the deep end of a pool. An installer must measure and position the pool cover storage mechanism relative to the pool cover box and to the pool itself This requires multiple measurements which allows for the introduction of error in the alignment of the pool cover. Since each installer custom installs pool cover boxes and equipment this leads to non-uniform installations which in turn leads to expensive support by the manufacture.

Another problem with conventional automatic pool cover boxes is that adjustments to position the equipment in an automatic pool cover box often requires a disassembly of some of the parts and a remounting of parts. If a misalignment in the pool cover is detected the mounted equipment has to be unfastened, measured, repositioned and reattached to correct the misalignment.

What is needed in the art is an equipment mounting assembly which fits into an automatic pool cover box, provides pre-positioned installation, is adjustable without remounting parts and does not require customized installation.

SUMMARY OF THE INVENTION

The present invention provides an equipment mounting assembly which fits into an automatic pool cover box in a pre-positioned manner and is adjustable without remounting parts.

The invention comprises, in one form thereof, an equipment mounting assembly for mounting equipment in a pool cover box, including at least one positioning feature configured to engage at least two walls of the pool cover box and at least one mounting plate, the at least one positioning feature adjustably connected to the mounting plate.

An advantage of the present invention is that the pool cover box equipment mounting assembly allows installation of pool cover equipment in a uniform manner.

A further advantage is the pool cover box equipment mounting assembly allows installation of the assembly without the need to attach parts to the walls or bottom of the pool cover box.

Yet another advantage is the pool cover box mounting equipment assembly is adjustable.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
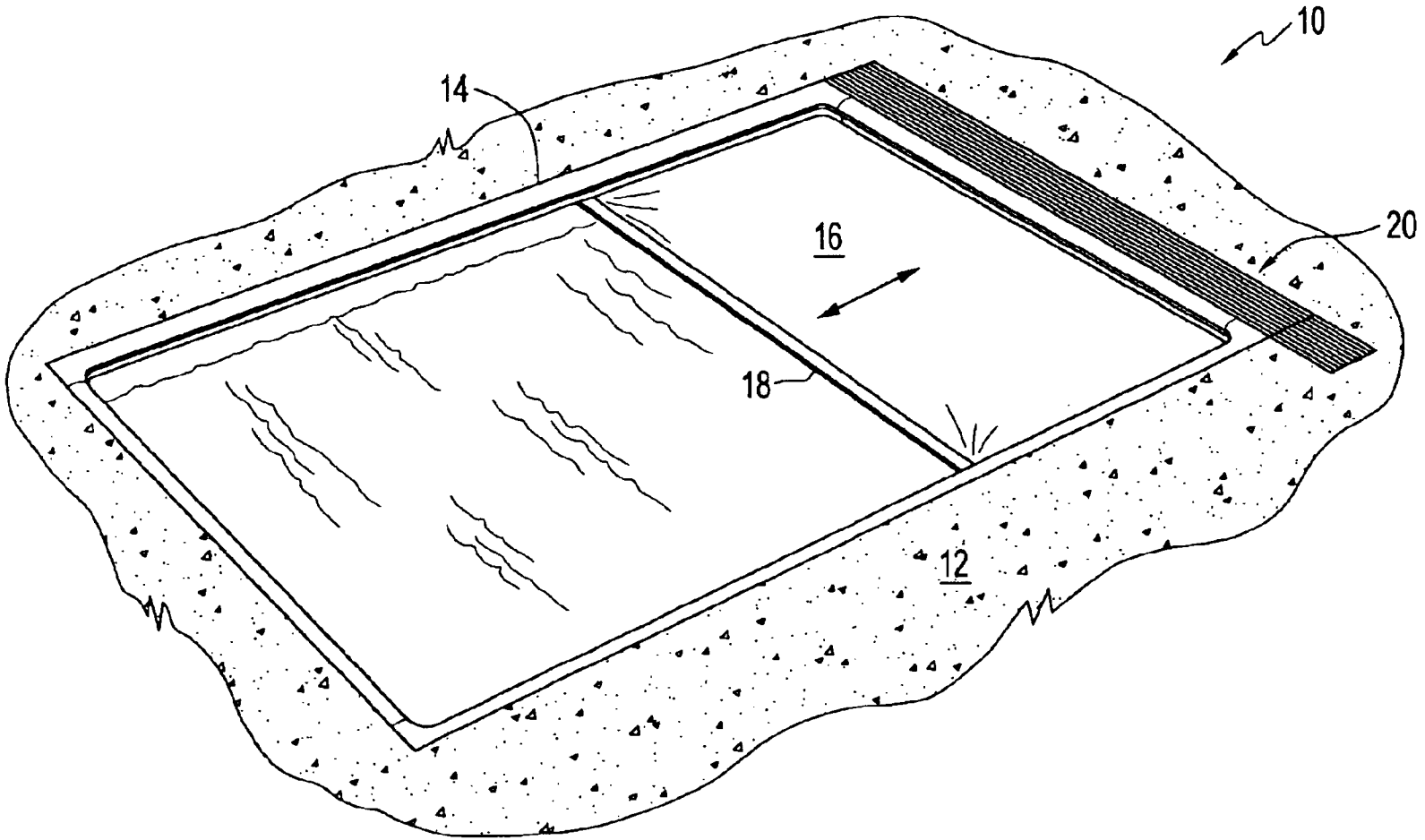
FIG. 1 is a perspective view of a swimming pool including an embodiment of an automatic pool cover box equipment mounting assembly of the present invention.

Referring now to the drawings, and more particularly to FIG. 1, there is shown an embodiment of a swimming pool 10 including a deck 12, a coping 14, a cover 16, a leading edge bar 18 and a pool cover box assembly 20 of the present invention.

Deck 12 is generally horizontal and is preferably constructed from concrete. Coping 14 connects to deck 12 in a substantially coplanar fashion along the edge of deck 12 facing the interior of swimming pool 10.

Coping 14 is connected to deck 12 and provides a track allowing leading edge bar 18 to slide therein. The general shape of the exposed portion of coping 14 is generally curved such that there are no exposed sharp corners.

Cover 16 is attached to leading edge bar 18 which pulls cover 16 from pool cover box assembly 20, through an opening existing between pool cover box assembly 20 and a top edge of swimming pool 10, across the length of swimming pool 10. To prepare swimming pool 10 for use, cover 16 retracts into pool cover box assembly 20 pulling leading edge bar 18 to the previously described opening.

Leading edge bar 18 is connected to cover 16 and provides support along the leading edge of cover 16. Each end of leading edge bar 18 is connected to at least one cable or rope (not shown) and is slidably connected to a track in coping 14. Leading edge bar 18 is shaped in a manner to be unobtrusive and aesthetically pleasing when located at either end of swimming pool 10.

Figure 2:
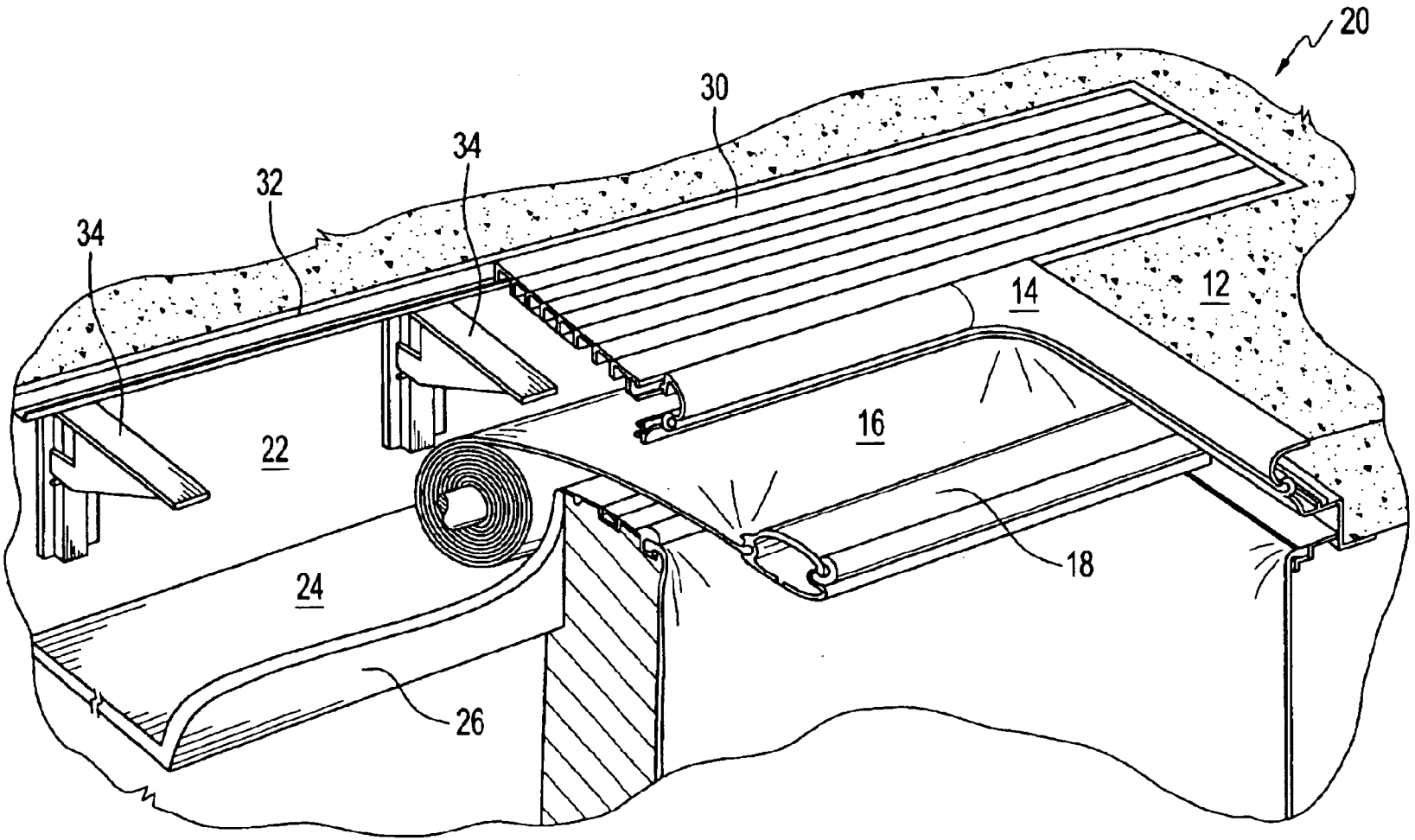
FIG. 2 is a partially sectioned perspective view of the automatic pool cover box equipment mounting assembly of FIG. 1.
Figure 3:
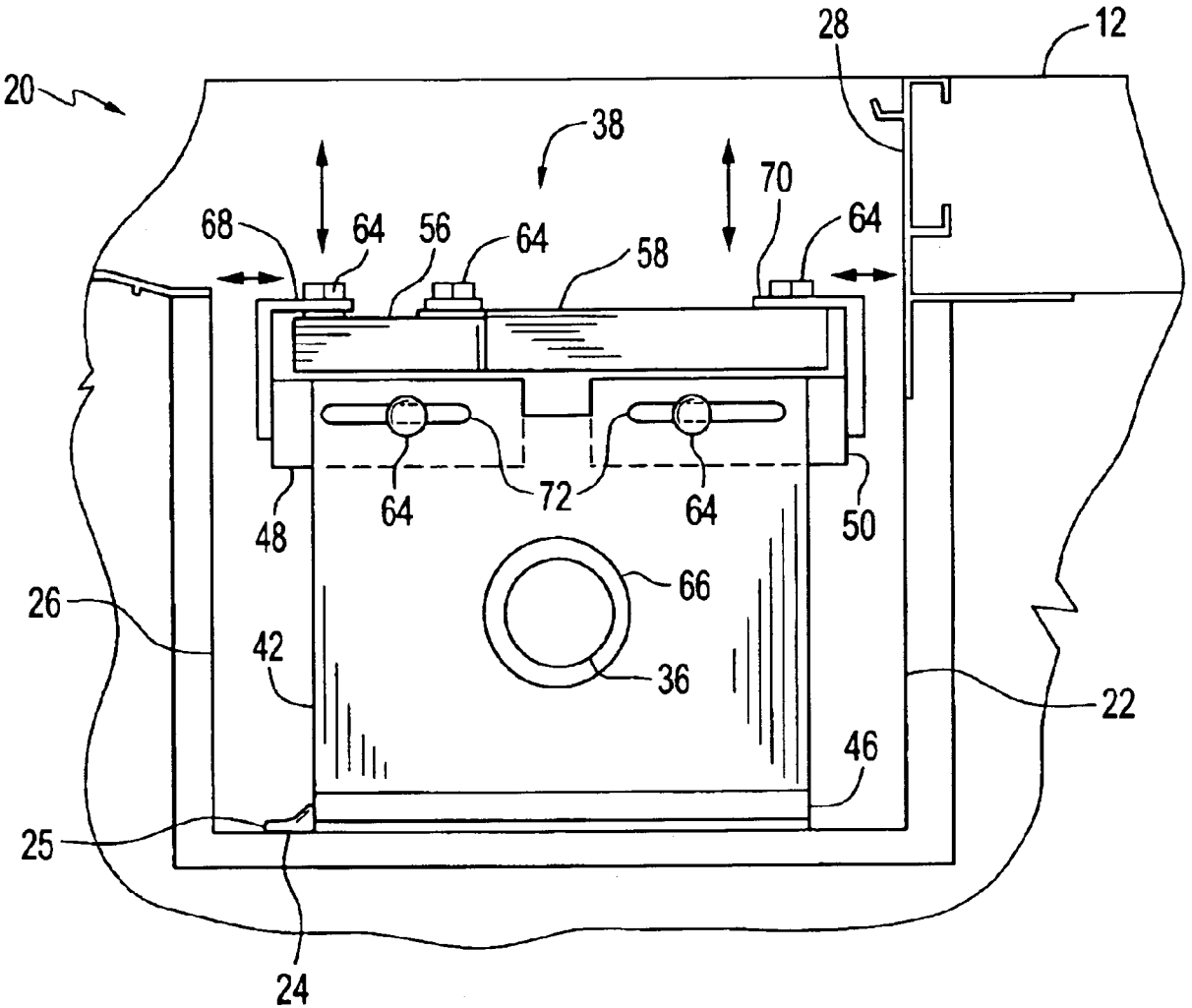
FIG. 3 is an end, sectional view of the automatic pool cover box equipment mounting assembly of FIGS. 1 and 2.
Figure 6:
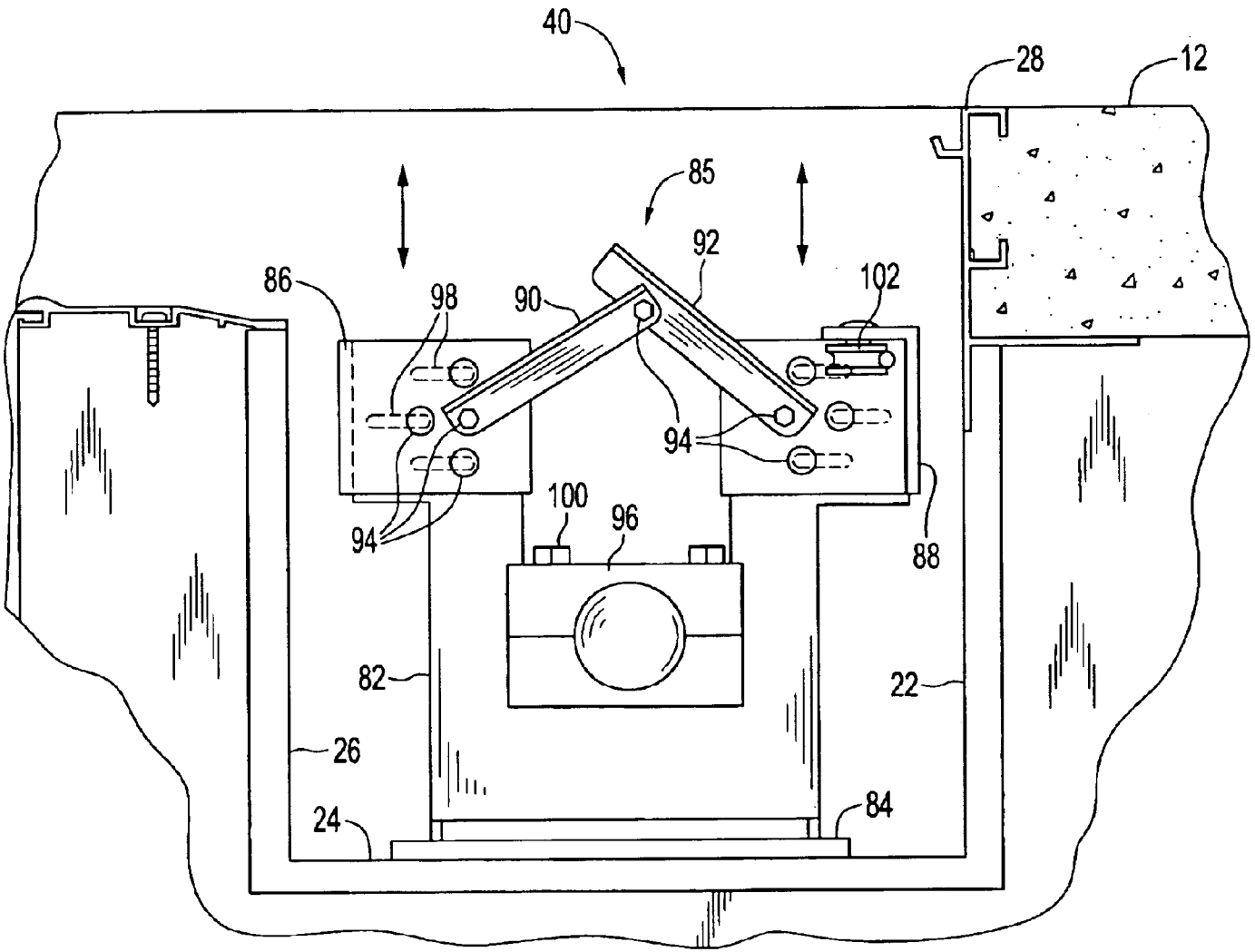
FIG. 6 is an end view of another embodiment of an equipment mounting assembly of FIGS. 1 and 2.

Now additionally referring to FIGS. 2, 3 and 6, pool cover box assembly 20 includes a rear wall 22, a bottom 24, a front wall 26, a coupling 28, lid 30, lid edge support 32, a plurality of lid support brackets 34, shaft 36, first mounting assembly 38 and second mounting assembly 40. Pool cover box assembly 20 also houses a drive mechanism (not shown) which drives shaft 36 and a rope and pulley system for the extension and retraction of cover 16. When cover 16 is retracted from swimming pool 10, cover 16 is wrapped around shaft 36 a number of times corresponding to the length of swimming pool 10.

Rear wall 22, bottom 24 and front wall 26 are arranged to form three sides of pool cover box assembly 20 adjacent and generally parallel to one end of swimming pool 10. The top edge of front wall 26 is parallel to a plane formed by deck 12 and is disposed therebelow. Locating feature 25 is arranged to provide a pre-located stop against which a mounting assembly may be located.

Coupling 28 has protrusions along a back side to engage the concrete of deck 12 and has an L-shaped upper portion, extending from a front side, to accommodate a portion of lid 30. The top edge of coupling 28 is substantially coplanar with deck 12.

The rear edge of lid 30 is shaped to engage coupling 28 so that lid 30 does not slide from its intended position. Lid 30 rests upon support brackets 34. The front edge of lid 30 is connected to lid edge support 32.

Lid edge support 32 is fastened to lid 30 and is disposed above the top of front wall 26 forming an opening therebetween. This opening is generally parallel with the plane of deck 12 and is such that cover 16 may be freely extended over swimming pool 10 and retracted into pool cover box assembly 20.

Lid support brackets 34 extend over the top of shaft 36 and provides support to lid 30. Lid support brackets 34 are vertically positioned to accommodate the thickness of lid 30. Lid support brackets 34 are adjustable such that lid 30 can be positioned at a desired angle to deck 12 or such that lid 30 is substantially coplanar with deck 12.

Shaft 36 is rotatably mounted in first mounting assembly 38 and second mounting assembly 40. Cover 16 is positioned on shaft 36 between first mounting assembly 38 and second mounting assembly 40. Shaft 36 may include a reel mounted on shaft 36, the reel providing a desired diameter for storing cover 16 and ends to keep cover 16 aligned.

Figure 4:
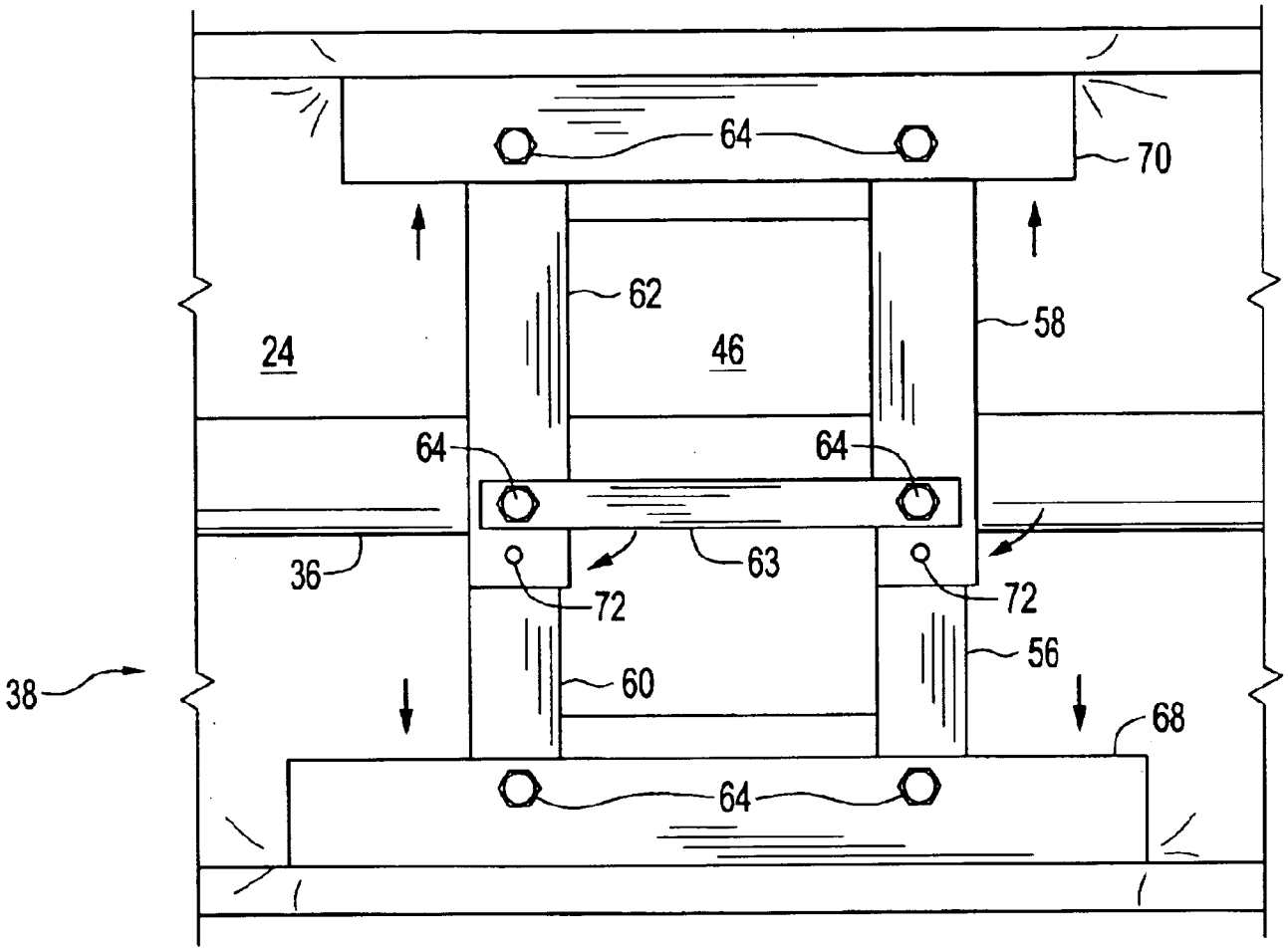
FIG. 4 is a top view of the equipment mounting assembly of FIG. 3.
Figure 5:
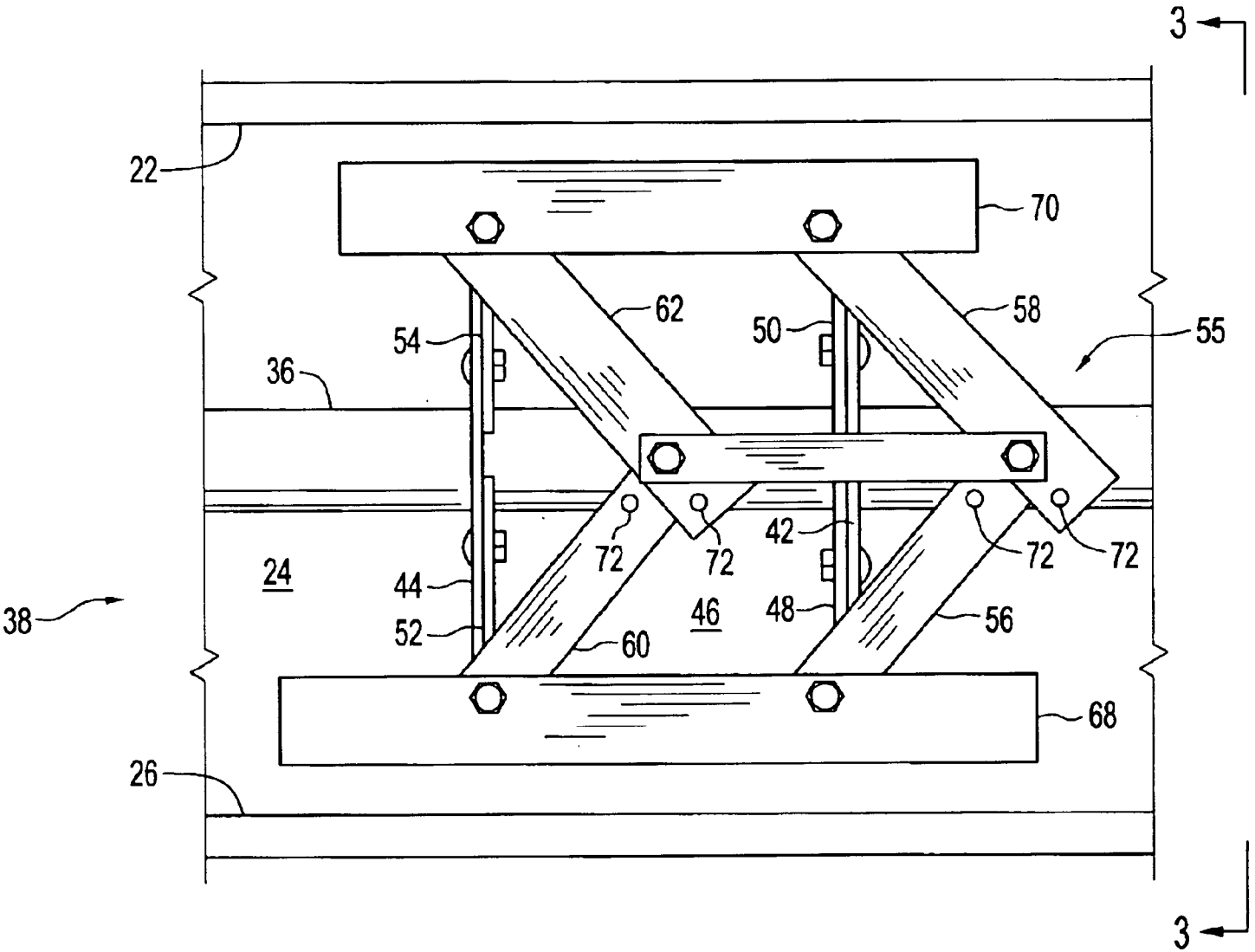
FIG. 5 is another top view of the equipment mounting assembly of FIGS. 3 and 4.

Now additionally referring to FIGS. 4 and 5, first mounting assembly 38 includes a first mounting plate 42, a second mounting plate 44, a mounting plate bottom 46, a first sliding member 48, a second sliding member 50, a third sliding member 52, a fourth sliding member 54, a positioning feature in the form of positioning assembly 55 including a first connecting member 56, a second connecting member 58, a third connecting member 60, a fourth connecting member 62 and a coordinating member 63, bolts 64, bearings 66, a first engaging member 68 and a second engaging member 70.

First mounting plate 42 and second mounting plate 44 are substantially similar. Mounting plates 42 and 44 each have at least two slots 72 to accommodate sliding members 48, 50, 52 and 54 and a hole to accommodate shaft 36 and bearing 66. Mounting plates 42 and 44 are connected along their bottom edge to mounting plate bottom 46.

Mounting plate bottom 46 is a substantially flat plate which serves to space mounting plates 42 and 44 and connect the bottom edges of mounting plates 42 and 44 such that mounting plates 42 and 44 are substantially parallel to each other and such that the holes therein are substantially coaxially located. Alternatively, mounting plates 42 and 44 along with mounting plate bottom 46 may be formed from a single piece of formed material.

First sliding member 48, second sliding member 50, third sliding member 52 and fourth sliding member 54 are substantially similar. Sliding members 48 and 50 each have a hole through which bolts 64 extend such that sliding members 48 and 50 are slidably connected to mounting plate 42 by way of slots 74 and bolts 64, and in a substantially similar manner sliding members 52 and 54 are slidably connected to mounting plate 44. An end of sliding members 48 and 52 extend from the side of mounting plates 42 and 44, respectively, and are each attached to engaging member 68. In a substantially similar manner an end of sliding members 50 and 54 extend from another side of mounting plates 42 and 44, respectively, and are each attached to engaging member 70.

Positioning assembly 55 provides for spaced positioning of first mounting assembly 38 inside of pool cover assembly 20. Positioning assembly 55 extends to engage walls 22 and 26, and thereby provide rigidity to first mounting assembly 38.

First connecting member 56 and third connecting member 60 are substantially similar to each other and second connecting member 58 and fourth connecting member 62 are substantially similar to each other. Connecting members 56, 58, 60 and 62 are formed from material having an 'L' cross-sectional profile. Connecting members 56 and 60 each have one end separately pivotally connected to engaging member 68 by way of bolts 64. An other end of connecting member 56 is pivotally connected to an end of connecting member 58 and an end of coordinating member 63. An other end of coordinating member 63 is pivotally connected to an other end of connecting member 60 and an end of connecting member 62. The other ends of connecting members 58 and 62 are separately pivotally connected to engaging member 70. Connecting members 56, 58, 60 and 62 each have a securing hole 72 positioned such that when engaging members 68 and 70 are fully extended that securing holes 72 in connecting members 56 and 58 substantially align and securing holes 72 in connecting members 60 and 62 substantially align. When securing holes 72 are aligned, bolts or other devices may be inserted through holes 72 to lock engaging members 68 and 70 in a fully extended position.

Coordinating member 63 is pivotally connected at one end to connecting members 56 and 58, and is pivotally connected at an other end to connecting members 60 and 62. Coordinating member 63 is a substantially flat piece of material. Coordinating member 63 provides for a substantially similar movement in connecting members 56 and 58, and in connecting members 60 and 62, allowing a substantially parallel movement of engaging members 68 and 70 relative to each other.

Bolts 64, which include washers and nuts, are used as pivoting points and for slidable engagement of parts. Bolts 64 may be in the form of shoulder bolts. Alternatively, rivets or other devices which allow for pivotal and sliding motion may be used in lieu of bolts 64.

Bearings 66 are mounted in mounting plates 42 and 44 to provide rotatable support to shaft 36. Bearing 66 may be in the form of a synthetic or metal bushing. Alternatively, bearings 66 may be eliminated if the drive mechanism provides for the rotatable support of shaft 36, in which case clearance around shaft 36 is provided in mounting plates 42 and 44.

First engaging member 68 and second engaging member 70 are substantially similar. First engaging member 68 is pivotally connected to first connecting member 56 and third connecting member 60, at two respective places, spaced along the length of first engaging member 68. In a substantially similar manner second engaging member 70 is pivotally connected to second connecting member 58 and fourth connecting member 62, at two respective places, spaced along the length of second engaging member 70. Engaging members 68 and 70 each have an 'L' shaped cross-sectional profile. Engaging members 68 and 70 are oriented such that a flat side is substantially parallel to rear wall 22 and front wall 26. The flat side of engaging members 68 and 70 extend out from first mounting assembly 38 and contact rear wall 22 and front wall 26 as engaging members 68 and 70 extend.

Between first mounting plate 42 and second mounting plate 44 a reel (not shown) may be secured to shaft 36 around which cable (not shown), used in the deployment and retraction of cover 16, is wound.

Figure 7:
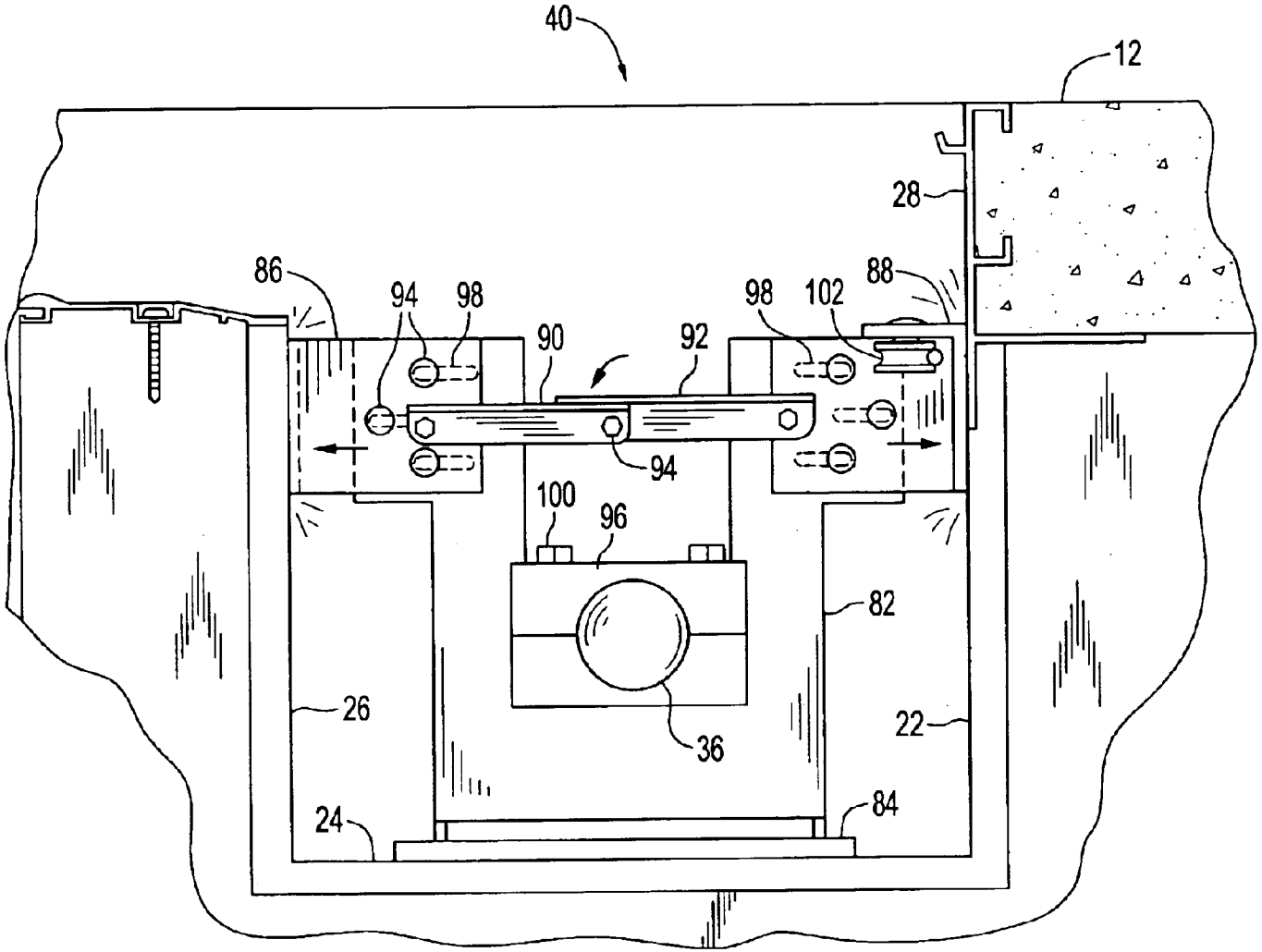
FIG. 7 is another end view of the equipment mounting assembly of FIG. 6.

Now referring solely to FIGS. 6 and 7, second mounting assembly 40 includes mounting plate 82, mounting plate bottom 84, positioning assembly 85 including first sliding member 86, second sliding member 88, first connecting member 90 and second connecting member 92, bolts 94 and bearing 96.

Mounting plate 82 has a plurality of slots 98 and a central cavity to accommodate shaft 36 and bearing 96. Mounting plate 82 is connected in a substantially perpendicular manner along the bottom edge of mounting plate 82 to mounting plate bottom 84.

Mounting plate bottom 84 is a substantially flat plate which is connected to the bottom edge of mounting plate 82. Alternatively, mounting plate 82 and mounting plate bottom 84 may be formed from a single piece of formed material.

Positioning assembly 85 provides for spaced positioning of second mounting assembly 40 inside of pool cover assembly 20. Positioning assembly 85 extends to engage walls 22 and 26, and thereby provide rigidity to second mounting assembly 40.

First sliding member 86 and second sliding member 88 are substantially similar. Sliding members 86 and 88 each have a plurality of holes through which bolts 94 pass, and are slidably connected to mounting plate 82 by way of slots 98 and bolts 94. Sliding members 86 and 88 each have an 'L' shaped cross-section, with the ends of sliding members 86 and 88, which extend from the side of mounting plate 82, being shaped as the bottom of the 'L'. As sliding members 86 and 88 extend from the sides of mounting plate 82 they engage rear wall 22 and front wall 26 of pool cover box assembly 20.

First connecting member 90 and second connecting member 92 are formed from material having an 'L' cross-sectional profile. First connecting member 90 has one end pivotally connected to first sliding member 86 by way of bolt 94. An other end of first connecting member 90 is pivotally connected to an end of second connecting member 92. An other end of second connecting member 92 is pivotally connected to second sliding member 88. As connecting members 90 and 92 are pressed down this causes sliding members 86 and 88 to extend in a horizontal outward direction. When sliding members 86 and 88 are fully extended, contacting rear wall 22 and front wall 26, bolts 94 are tightened to secure second mounting assembly 40 in position within pool cover box assembly 20.

Bolts 94, which include washers and nuts, are used as pivoting points and for slidable engagement of parts. Alternatively, rivets or other devices which allow for pivotal and sliding motion may be used in lieu of at least some of bolts 94.

Bearing 96 is mounted in a central cavity of mounting plate 82 to provide rotatable support to shaft 36. Bearing 96 may be in the form of synthetic or metal bushing blocks removably secured by bolts 100.

Pulleys 102 as shown in FIGS. 6 and 7 are mounted on equipment mounting assemblies 38 and 40 at positions to accommodate the routing and movement of cable within pool cover box assembly 20. The cable is routed out of pool cover box assembly 20 to connect with leading edge bar 18 thereby facilitating the movement of cover 16.

In another embodiment of the invention a method is provided for the installation of equipment mounting assemblies 38 and 40 in a pool cover box. One end of shaft 36 is positioned through the holes in equipment mounting assembly 38. An other end of shaft 36 is positioned in bearing 96 of equipment mounting assembly 40. Equipment mounting assemblies 38 and 40 are placed on bottom 24 of pool cover box 20 with shaft 36 being supported by bearing 96 and either bearings 66 or the drive mechanism. Connecting members 56, 58, 60 and 62 are moved causing engaging members 68 and 70 to contact rear wall 22 and front wall 26. Connecting members 90 and 92 are moved causing sliding members 86 and 88 to contact rear wall 22 and front wall 26. To secure equipment mounting assembly 38 securing holes 72 are aligned and pins or bolts are inserted therethrough. Equipment mounting assembly 40 is secured in position by tightening bolts 94.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

a cover configured to cover the swimming pool;

a reel carrying said cover; and a pool cover box assembly for containing said cover, comprising:

a plurality of walls defining the sides of said pool cover box assembly;

a bottom, at least one of said bottom and said plurality of walls having locating features; and at least one equipment mounting assembly located in said pool cover box assembly by contacting said locating features, comprising:

at least one positioning feature configured to engage two of said plurality of walls; and at least one mounting plate, said at least one positioning feature adjustably connected to said mounting plate wherein at least one said positioning feature comprises:

at least two sliding members including a first sliding member and a second sliding member, each said sliding member slidably connected to said mounting plate; and at least two connecting members including a first connecting member and a second connecting member, each connecting member having two ends, one end of said first connecting member being pivotally connected to said first sliding member, an other end of said first connecting member being pivotally connected to an end of said second connecting member, an other end of said second connecting member pivotally connected to said second sliding member.

2. The swimming pool of claim 1, wherein said plurality of walls include a front wall and a rear wall, said first sliding member configured to engage said front wall and said second sliding member configured to engage said rear wall.

3. The swimming pool of claim 1, wherein said at least one positioning feature further comprises:

at least two bolts; and at least two slots in said at least one mounting plate, said at least two slots being oriented in a substantially horizontal manner, said at least two slots and said at least two bolts providing said slidable connection.

4. A pool cover box assembly for housing a swimming pool cover, comprising:

a plurality of walls defining the sides of said pool cover box assembly;

a bottom, at least one of said bottom and said plurality of walls having locating features;

at least one equipment mounting assembly located in said pool cover box assembly by contacting said locating features, comprising at least one positioning feature configured to engage two of said plurality of walls; and at least one mounting plate, said at least one positioning feature adjustably connected to said mounting plate, wherein at least one said positioning feature comprises:

at least two sliding members including a first sliding member and a second sliding member, each said sliding member slidably connected to said mounting plate; and at least two connecting members including a first connecting member and a second connecting member, each connecting member having two ends, one end of said first connecting member being pivotally connected to said first sliding member, an other end of said first connecting member being pivotally connected to an end of said second connecting member, an other end of said second connecting member pivotally connected to said second sliding member.

5. The pool cover box assembly of claim 4, wherein said plurality of walls include a front wall and a rear wall, said first sliding member configured to engage said front wall and said second sliding member configured to engage said rear wall.

6. The pool cover box assembly of claim 4, wherein said at least one positioning feature further comprises:

at least two bolts; and at least two slots in said at least one mounting plate, said at least two slots being oriented in a substantially horizontal manner, said at least two slots and said at least two bolts providing said slidable connection.

7. An equipment mounting assembly for mounting equipment in a pool cover box, comprising:

at least one positioning feature configured to engage at least two walls of the pool cover at least one mounting plate, said at least one positioning feature adjustably connected to said mounting plate, wherein at least one said positioning feature comprises:

at least two sliding members including a first sliding member and a second sliding member, each said sliding member slidably connected to said mounting plate; and at least two connecting members including a first connecting member and a second connecting member, each connecting member having two ends, one end of said first connecting member being pivotally connected to said first sliding member, an other end of said first connecting member being pivotally connected to an end of said second connecting member, an other end of said second connecting member pivotally connected to said second sliding member.

8. The equipment mounting assembly of claim 7, wherein said at least one positioning feature further comprises;

at least two bolts; and at least two slots in said at least one mounting plate, said at least two slots being oriented in a substantially horizontal manner, said at least two slots and said at least two bolts providing said slidable connection.

* * * * *